US005551271A

United States Patent [19]

Gray et al.

[11] Patent Number: 5,551,271

[45] **Date of Patent: *Sep. 3, 1996**

[54] U-BOLT BENDING APPARATUS

[75] Inventors: John C. Gray; Jerry W. Corder, both of Dayton, Ohio

[73] Assignee: L&H Threaded Rods Corporation, Dayton, Ohio

[ * ] Notice: The term of this patent shall not extend beyond the expiration date of Pat. No. 5,461,897.

[21] Appl. No.: 306,402

[22] Filed: Sep. 15, 1994

Related U.S. Application Data

[63] Continuation-in-part of Ser. No. 129,672, Sep. 30, 1993, Pat. No. 5,461,897.

[51] Int. Cl.[6] ..... B21K 1/74; B21D 7/06

[52] U.S. Cl. ..... 72/213; 72/456; 72/453.12

[58] Field of Search ..... 72/212, 213, 215, 72/383, 389, 447, 452, 453.12, 456

[56] References Cited

U.S. PATENT DOCUMENTS

| | | | |
|---|---|---|---|
| 2,918,101 | 12/1959 | Riker | 72/213 |
| 4,446,711 | 4/1985 | Valente | 72/213 |
| 4,696,180 | 7/1987 | Zandel | 72/456 |
| 4,936,131 | 5/1990 | Gray | 72/213 |
| 5,461,897 | 10/1995 | Gray et al. | 72/213 |

OTHER PUBLICATIONS

Arctic Bend 35 Cold Forming U–Bolt Bender, Turner's Manufacturing—Turner's Alignment & Brake Service, Inc., Muncie, Indiana.

*Primary Examiner*—Lowell A. Larson
*Assistant Examiner*—Thomas C. Schoeffler
*Attorney, Agent, or Firm*—Jacox, Meckstroth & Jenkins

[57] ABSTRACT

A vertical frame supports an interchangeable mandrel or die which receives the center portion of an elongated metal rod having opposite threaded end portions, and the rod is clamped to the die by a pivotal locking bar secured by a wedge actuated by a hydraulic cylinder. The frame also includes a vertical plate having upper and lower corner blocks connected by a pair of vertical guide rods. The rods support a horizontal carriage cross bar for vertical movement, and the cross bar pivotally supports upper end portions of a pair of arms each formed by rigidly connected parallel spaced plates having aligned straight cam slots. A pair of bending rollers are supported by the lower end portions of the arms, and a hub member extends between the plates of each arm and supports slide blocks which move within the cam slots. A hydraulic cylinder moves the cross bar vertically to move the arms and bending rollers along converging paths for overbending the rod around the die. An elongated adjustment screw is rotatably supported by the lower corner blocks and a center block and extends between the plates forming the arms. The screw has oppositely threaded portions engaging the hub members to provide for conveniently and precisely adjusting the spacing between the bending rollers for accommodating dies and rods of different sizes and shapes.

22 Claims, 2 Drawing Sheets

U-BOLT BENDING APPARATUS

RELATED APPLICATION

This application is a continuation-in-part of application Ser. No. 08/129,672, filed Sep. 30, 1993, now U.S. Pat. No. 5,461,897.

BACKGROUND OF THE INVENTION

In the art of machines for cold bending threaded rods into U-bolts, for example, of the general type disclosed in U.S. Pat. No. 4,936,131 issued to a co-inventor of the present invention, it is common to position an unthreaded center portion of a metal rod having opposite threaded end portions onto a mandrel or die and to bend the rod around the die by moving a pair of bending rollers along parallel linear paths on opposite sides of the die. The bending rollers are usually supported by arms which form part of a movable carriage actuated by a hydraulic cylinder. The arms are adjustable by a connecting adjustment screw extending from a hand wheel or crank for adjusting the spacing between the bending rollers to accommodate dies of different sizes and shapes and also for accommodating rods of different diameters.

The bending operation is produced by extending and retracting the carriage and the bending rollers so that the metal rod is bent into a generally U-shaped configuration to form a U-bolt. While the bending rollers form the U-bolt with parallel legs having the threaded end portions, when the carriage and bending rollers are retracted, the metal rod springs back slightly so that the legs are no longer precisely parallel and diverge outwardly by a slight angle.

U-bolt bending machines have been constructed wherein the bending rollers are carried by corresponding end portions of pivotally supported arms, and the arms are backed-up by corresponding rollers. The back-up rollers cause the arms and rod bending rollers to move inwardly or converge as the bending rollers move past the die in order to obtain overbending of the rod around the die. Thus when the arms and bending rollers are retracted, the leg portions spring back to substantially parallel positions. The backup rollers have also been supported by corresponding adjustable blocks in order to adjust the slightly converging paths of the bending rollers when the carriage moves from its retracted position to its extended position. Such a bending machine, which overbends the U-bolts to obtain substantially parallel legs, has been used for high volume production of one size U-bolts since substantial down time of the bending machine is required to adjust or reset the backup roller support blocks when a different mandrel is used or different diameter rods are to be bent into U-bolts. One such U-bolt bending machine was constructed and used by Turner's Alignment and Brake Service, Inc. in Muncie, Ind. and sold under the trademark "Arctic Bend".

SUMMARY OF THE INVENTION

The present invention is directed to an improved apparatus or machine for cold bending a metal rod having opposite threaded end portions into a U-bolt having parallel legs formed by the end portions. The apparatus of the invention not only provides for overbending the rod so that the threaded legs are parallel after the bending operation, but also provides for conveniently accommodating interchangeable mandrels or dies of different shapes or sizes and also threaded rods of different lengths and diameters. The U-bolt bending apparatus or machine of the invention may also be positioned horizontally or vertically if it is desired to minimize the floor space required by the machine.

In accordance with one embodiment of the invention, a vertical tubular frame supports an interchangeable mandrel or forming die which receives the center portion of a metal rod having threaded end portions. The frame also includes a vertical plate which has upper and lower corner blocks supporting horizontally spaced vertical guide rods. A carriage cross bar is supported by the guide rods for vertical movement and pivotally supports a pair of depending arms which have lower end portions supporting a corresponding pair of bending rollers. Each of the roller support arms is formed by a pair of parallel spaced plates which define corresponding laterally aligned straight slots within the arms.

A hub member extends through the slots within each arm and supports a pair of blocks which slide on cam surfaces defining the slots. A hydraulic cylinder is supported by the top portion of the frame and has a downwardly projecting piston rod connected to the carriage cross bar for moving the arms and bending rollers vertically along slightly converging paths extending adjacent the bending die. An adjusting screw is rotatably supported by the lower corner blocks and a center block and extends between the parallel plates of each arm. The screw has oppositely threaded portions engaging hubs supporting the slide blocks, and hand wheels are mounted on opposite end portions of the adjusting screw. Rotation of the screw provides for conveniently adjusting the spacing between the bending rollers for accommodating threaded rods of different diameters and bending dies of different sizes and shapes while also providing for overbending of the rod around the die. The adjustment screw has adjustable thrust collars on opposite side of the center support block to provide for precisely positioning the screw axially with respect to the forming die.

Other features and advantages of the invention will be apparent from the following description, the accompanying drawing and the appended claims.

DESCRIPTION OF THE PREFERRED EMBODIMENT

Figure 1:
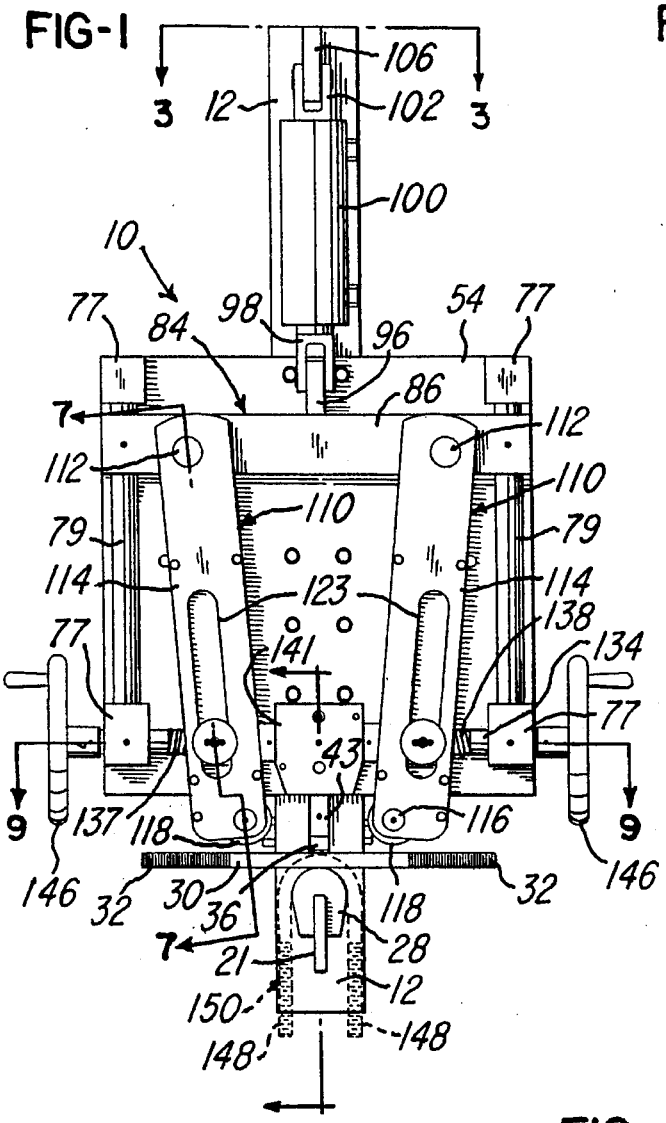
FIG. 1 is a front elevational view of a U-bolt bending machine constructed in accordance with the invention.
Figure 3:
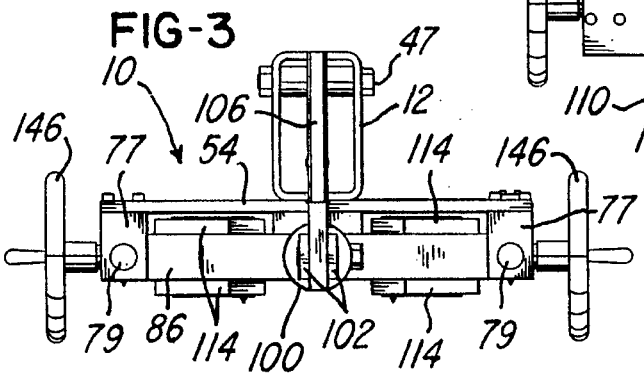
FIG. 3 is a top view of the machine, taken generally on the line 3—3 of FIG. 1.
Figure 4:
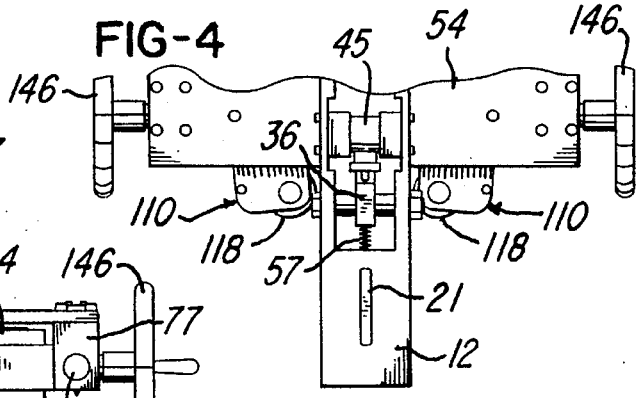
FIG. 4 is a fragmentary rear view taken generally on the line 4—4 of FIG. 2.

FIG. 1 illustrates a bending apparatus or machine 10 which includes a vertical tubular frame 12 of heavy gauge steel and having a rectangular cross-sectional configuration (FIG. 3). A bar 21 (FIG. 5) projects through slots within the bottom portion of the frame 12 and is welded to the front and rear walls of the frame. The forward end portion of the bar 21 receives an inverted U-shaped mandrel or forming die 28 which slides downwardly into grooves (not shown) formed within the sides of the bar 21. The die 28 is interchangeable with other dies of different shapes and different widths and may be replaced simply by lifting the die from the bar 21.

Figure 5:
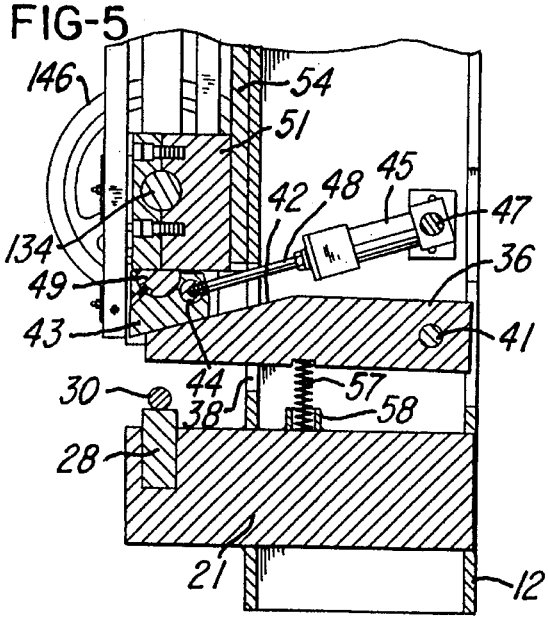
FIG. 5 is an enlarged fragmentary section taken generally on the line 5—5 of FIG. 1 and showing the rod clamping mechanism in a released position.
Figure 6:
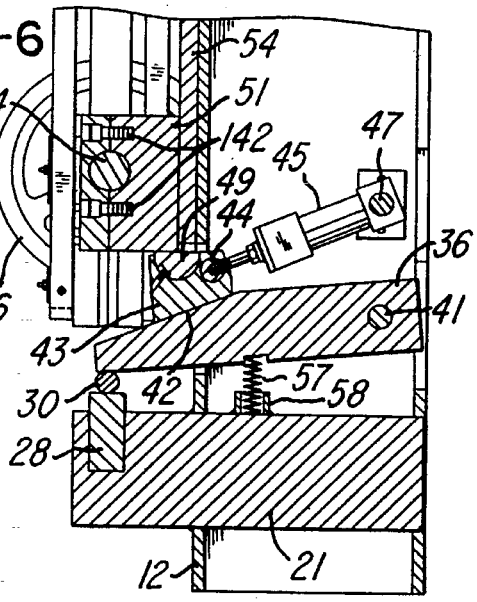
FIG. 6 is a view similar to FIG. 5 and showing the clamping mechanism in a positive locked position.

The upper part of the die 28 is adapted to receive and support the center portion of a straight cylindrical metal rod 30 having opposite threaded end portions 32. Preferably, the center of the rod 30 and the top of the die 28 are provided with corresponding marks in accordance with above mentioned U.S. Pat. No. 4,936,131 in order to provide for conveniently and quickly positioning the rod 30 on the die 28 regardless of the length of the rod 30. As shown in FIGS. 5 & 6, the center portion of the rod 30 is clamped to the die 28 by a lever arm 36 which projects through a slot 38 within the front wall of the frame 12 and is pivotally supported by a cross shaft 41.

The outer or forwardly projecting end portion of the lever arm 36 has an inclined top cam surface 42 which supports a sliding wedge block 43 having a part cylindrical recess receiving a rotatable cross pin 44. A double acting hydraulic cylinder 45 is pivotally supported by a cross bolt 47 secured to the frame 12 and includes a piston rod 48 having an outer end portion threadably connected to the rotatable cross pin 44 within the wedge block 43. A semi-cylindrical bar 49 is rotatably supported within a mating cavity within the top portion of the wedge block 43 and slidably engages the bottom surface of a bearing support block 51 (FIGS. 1 & 5) mounted on the bottom center portion of a vertical and rectangular steel support plate 54 secured or bolted to the front wall of the frame 12.

When the cylinder 45 is actuated to extend the piston rod 48, the wedge block 43 is in the released position shown in FIG. 5. This permits the lever arm 36 to move to its generally horizontal retracted position in response to an upward force produced by a compression spring 57 confined within a tubular socket 58 secured to the bar 21. When the cylinder 45 is actuated to retract the piston rod 48, the lever arm 36 is forced downwardly to compress the spring 57 and to clamp the center portion of the threaded rod 30 to the upper surface of the forming die 28, and shown in FIG. 6.

Figure 2:
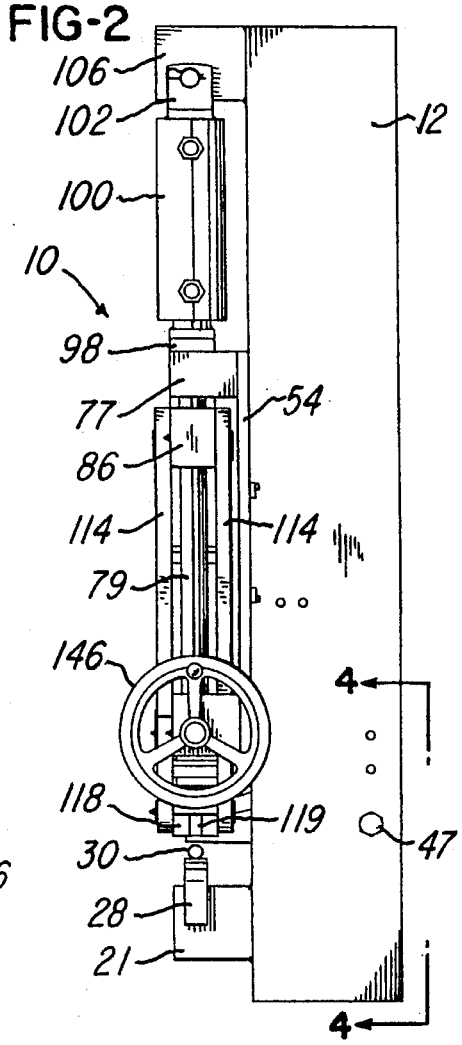
FIG. 2 is a side elevational view of the bending machine shown in FIG. 1.

Referring to FIG. 1, a set of upper and lower blocks 77 are secured or welded to the four corner portions of the vertical plate 54, and corresponding blocks 77 are rigidly connected by parallel spaced vertical guide rods 79. The vertical guide rods 79 support a carriage 84 for vertical sliding movement. The carriage 84 includes a horizontal cross bar 86 (FIG. 1) which has end portions each retaining a sleeve-type bearing (not shown) for receiving the corresponding guide rod 79. A plate 96 is secured or welded to the center of the cross bar 86 and receives an inverted U-shaped yoke member 98 which is secured to the piston rod of a hydraulically actuated cylinder 100. As shown in FIGS. 1 and 2, a U-shaped bracket 102 is welded to the top of the cylinder 100 and projects upwardly to receive a horizontal bar 106 and a cross pin 107. The bar 106 projects through slots within the front and rear walls of the frame 12 and is welded to the frame 12 in the same manner as the bar 21 (FIG. 5) at the bottom of the frame.

Figure 7:
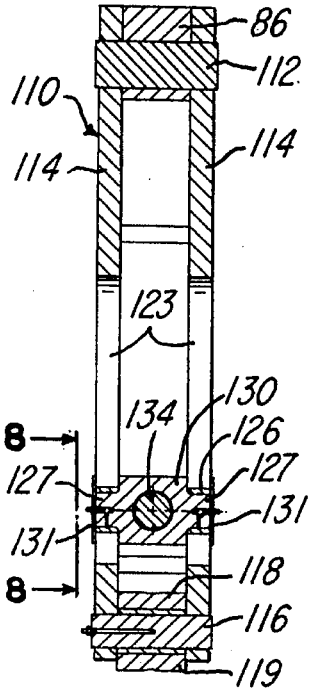
FIG. 7 is a fragmentary section taken generally on the line 7—7 of FIG. 1.
Figure 8:
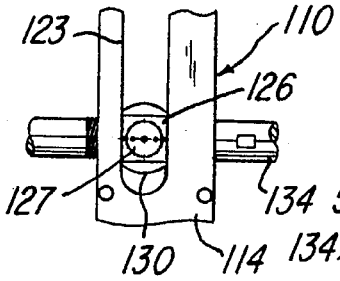
FIG. 8 is a view taken generally on the line 8—8 of FIG. 7 with a retainer plate removed.

The carriage 84 also includes a pair of arms 110 which have upper end portions pivotally connected to the cross bar 86 by corresponding pivot shafts 112 (FIGS. 1 & 7). Each of the arms 110 is formed by a pair of parallel spaced plates 114 which have lower end portions supporting a cross shaft 116 on which is mounted a bending roller 118 having a peripherally extending groove 119. Each pair of arm plates 114 also have aligned straight or linear slots 123. The slots 123 of each arm 110 receive corresponding bearing blocks 126 (FIGS. 7 & 8) having flat surfaces which slide within the slots 123. The bearing blocks 126 are mounted on reduced cylindrical end portions 127 of a spacer hub 130. Circular retaining plates 131 are secured to the outer ends of the hub 130 by a set of screws.

Figure 10:
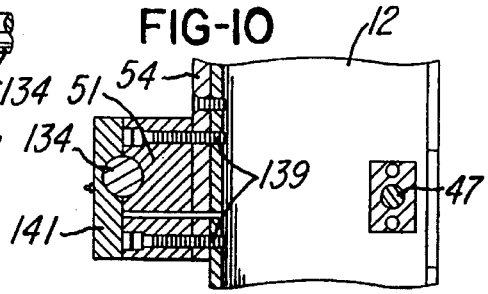
FIG. 10 is a fragmentary section taken generally on the line 10—10 of FIG. 9.
Figure 9:
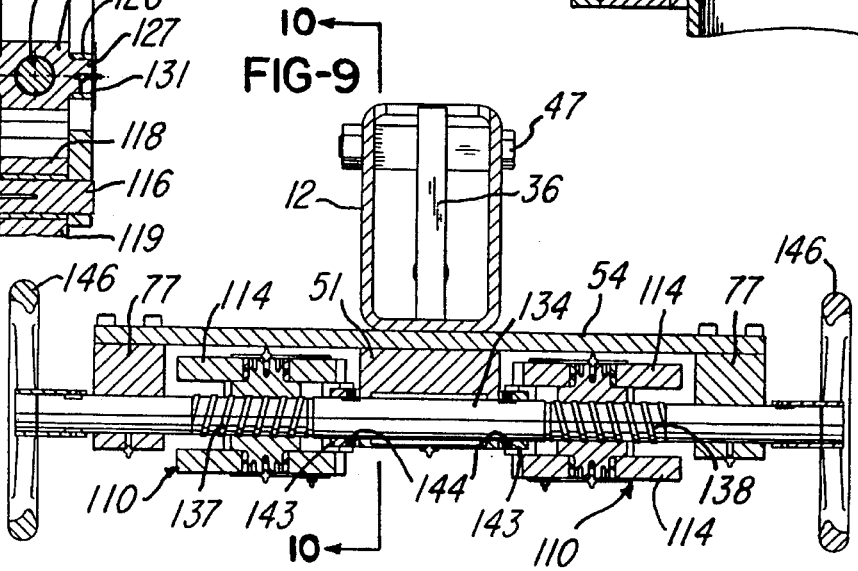
FIG. 9 is a section taken generally on the line 9—9 of FIG. 1.

An adjustment screw 134 (FIGS. 1 & 9) has opposite end portions rotatably supported by the lower set of blocks 77 projecting from the plate 54. The adjustment screw 134 also has axially spaced threaded portions 137 and 138 which have reverse threads and extend through correspondingly threaded holes within the hubs 130. The center portion of the adjustment screw 134 is rotatably supported by the center bearing block 51 (FIG. 10) secured to the plate 54 and front wall of the frame 12 by a set of screws 139. The center portion of the adjustment screw 134 is held to the block 51 by a plate 141 retained by a set of screws 142 (FIG. 6). A pair of adjustment thrust collars 143 (FIG. 9) are secured to the screw 134 on opposite sides of the support block 51 and are locked by set screws 144. A pair of crank-type hand wheels 146 are secured to opposite ends of the adjustment screw 134.

As apparent from FIG. 1, when the adjustment screw 134 is rotated in one direction or the opposite direction, the arms 110 pivot inwardly or outwardly on the shafts 112 for adjusting and precisely selecting the space between the forming or bending rollers 118. This spacing is selected according to the size of the mandrel or die 28 and the diameter of the threaded rod 30. The thrust collars 139 are adjusted axially in the screw 134 to position the bending rollers 118 precisely symmetrical with respect to the die 28.

In operation of the bending apparatus or machine shown in FIGS. 1–10, after a threaded rod 30 is positioned on the die 28 and clamped by the locking arm 36 in response to retraction of the wedge block 43 with the cylinder 45. The hydraulic cylinder 100 is then actuated to extend its piston rod and move the carriage 84 and arms 110 downwardly so that the bending rollers 118 bend the rod 30 around the die 28. As a result of the cam slots 123 and the stationary hubs 130 and bearing blocks 126, the bending rollers 118 have converging and slightly non-linear paths as the carriage 84 moves downwardly. As a result, the rod 30 is overbent around the die 28 as illustrated in FIG. 1 by the converging threaded end portions or legs 148 of a U-bolt 150 shown in phantom. When the carriage 84 is retracted upwardly and the bending rollers 118 move upwardly along diverging paths, the leg portions 148 of a U-bolt 150 spring outwardly to a parallel relationship, thereby producing a U-bolt with substantially parallel legs.

From the drawing and the above description, it is apparent that a rod bending apparatus or machine constructed in accordance with the present invention, provides desirable features and advantages. For example, the apparatus provides the feature of overbending a threaded rod 30 to obtain a U-bolt 150 with parallel legs 148 while also providing the feature of conveniently adjusting the spacing between the bending rollers 119 simply by rotating the adjustment screw 134 with one of the hand wheels 146. Thus the bending apparatus provides for conveniently bending rods of selective different diameters around mandrels or dies 28 of selective different sizes or shapes, as commonly required in spring shops where U-bolts of different sizes and shapes are used for attaching leaf springs to the axles of motor vehicles. The apparatus also operates in a vertical position for convenient handling of rods and U-bolts and for limiting the floor space required by the apparatus.

The construction of the bending machine 10 with the tubular steel frame 12 and the support plate 54 mounted on the beam, provides for a rigid, economical and durable construction, and the construction and support of the carriage 84 cooperate with the rigid frame 12 and the support of the die 28 by the bar 21 to provide for bending a threaded steel rod 30 having a substantial diameter, for example, up to 1¼ inches in diameter. The hydraulically actuated wedge block 43 between the block 51 and the pivotal locking arm 36 also assures positive clamping and locking of the threaded rod 30 to the die 28 with substantial force in order to permit bending a large diameter rod without the rod moving upwardly from the die 28.

Another advantage is provided by the sliding bearing blocks 126 within the straight cam slots 123 which avoids wearing of the slots when the descending arms 110 are subjected to substantial outward forces while the rollers 118 are bending a threaded rod of substantial diameter. In addition, the adjustable collars 139 mounted on the center portion of the adjustment screw 134 axially on opposite sides of the center support block 51, provide for precisely positioning the adjustment screw 134 axially after the bending machine is assembled to assure that the bending rollers 118 are precisely symmetrical with respect to the die 28 mounted on the support bar 21. The length of the arms 110 is also important for bending large diameter threaded rods into U-bolts. That is the length between the pivot pin 112 for each arm 110 and the axis of the corresponding bending roller 118 should be greater than 18 inches and preferably within the range of 22 to 29 inches.

While the form of bending apparatus herein described constitutes a preferred embodiment of the invention, it is to be understood that the invention is not limited to this precise form of apparatus, and that changes may be made therein without departing from the scope and spirit of the invention as defined in the appended claims.

The invention having thus been described, the following is claimed:

1. Apparatus for bending a straight metal rod having a center portion integrally connecting opposite threaded end portions into a U-bolt having parallel legs formed from the end portions, said apparatus comprising an elongated frame member, a removable forming die supported by said frame member and adapted to receive the center portion of the metal rod, a pair of support arms each supporting a bending roller positioned to engage the rod, a carriage member pivotally supporting said arms, means mounted on said frame member and supporting said carriage member for linear movement between a retracted position and an extended position, means for positively clamping a rod to said die and including a lever pivotally supported by said frame spaced from a support surface, a power actuated wedge member slidably engaging said lever and said support surface, power operated means for moving said carriage member and said arms between said retracted and extended positions, means for moving said arms and said rollers along converging paths in response to movement of said carriage member to said extended position for overbending the rod around said die, an adjustment screw connected to said means for moving said arms, and means for simultaneously adjusting said arms in response to rotation of said screw for conveniently adjusting the spacing between said bending rollers to accommodate rods and dies of different sizes.

2. Apparatus as defined in claim 1 wherein each of said arms has a cam surface, a corresponding bearing member having a substantially flat surface slidably engaging said cam surface, and said adjustment screw is threadably connected with reverse threads to said bearing members for precisely adjusting the spacing between said bending rollers.

3. Apparatus as defined in claim 1 wherein each of said arms comprises a set of parallel spaced plates each having laterally aligned slots defined by substantially flat cam surfaces, a follower member extending between said plates of each said arm and having means forming substantially flat surfaces slidably engaging said cam surfaces of said plates, and said adjusting screw extends between said plates of each said arm and has reverse threaded portions threadably engaging said follower members.

4. Apparatus as defined in claim 1 wherein said frame member comprises a steel tube having parallel spaced front and rear walls, and said means supporting said carriage member comprise a plate secured to said front wall.

5. Apparatus as defined in claim 4 and including parallel spaced cylindrical guide rods supported by said plate, and said power operated means comprise a hydraulic cylinder having a piston rod and extending between said frame and said carriage member.

6. Apparatus as defined in claim 1 and including a support block supported by said frame member and supporting a center portion of said screw for rotation, and a pair of thrust collars mounted on said screw on opposite sides of said support block for axial adjustment to provide for precisely positioning said arms and said bending rollers relative to said die.

7. Apparatus as defined in claim 1 wherein each of said arms comprises a set of parallel spaced plates each having laterally aligned substantially straight slots forming cam surfaces, a hub member extending between said plates of each said arm and supporting bearing blocks having substantially flat surfaces slidably engaging said cam surfaces of said plates, and said adjusting screw extends between said plates of each said arm and has threaded portions engaging said hub members.

8. Apparatus as defined in claim 1 wherein each of said arms has a length between the pivot axis for said arm and the axis of the corresponding said bending roller of substantially more than 18 inches.

9. Apparatus as defined in claim 1 and including a support block mounted of said frame and supporting a center portion of said screw for rotation, said support block includes said support surface opposing a cam surface on said lever, said wedge member is positioned between said support surface and said cam surface, and a hydraulic cylinder connecting said frame to said wedge member.

10. Apparatus as defined in claim 1 wherein said wedge member confines a rotatable cross pin connected to a hydraulic cylinder, and said wedge member supports a rotatable seat member engaging said support surface.

11. Apparatus as defined in claim 1 wherein said frame comprises a metal tube having parallel spaced front and rear walls, and a metal bar extending into aligned slots within said walls and projecting forwardly from said front wall to support said forming die.

12. Apparatus as defined in claim 11 and including a compression spring extending between said lever and said bar to bias said lever to a normally retracted position.

13. Apparatus as defined in claim 1 wherein said frame comprises a steel tube having parallel spaced front and rear walls, said means supporting said carriage member for linear movement comprise a plate secured to said front wall, and block members mounted on portions of said plate and supporting parallel spaced guide rods for said carriage.

14. Apparatus for bending a straight metal rod having a center portion integrally connecting opposite threaded end portions into a U-bolt having parallel legs formed from the end portions, said apparatus comprising an elongated frame member, a removable forming die supported by said frame member and adapted to receive the center portion of the metal rod, a pair of support arms each supporting a bending roller positioned to engage the rod, a carriage member pivotally supporting said arms, means mounted on said frame member and supporting said carriage member for linear movement between a retracted position and an extended position, means for positively clamping a rod to said die, power operated means for moving said carriage member and said arms between said retracted and extended positions, means for moving said arms and said rollers along converging paths in response to movement of said carriage member to said extended position for overbending the rod around said die, an adjustment screw connected to said means for moving said arms, means for simultaneously adjusting said arms in response to rotation of said screw for conveniently adjusting the spacing between said bending rollers to accommodate rods and dies of different sizes, a support block supported by said frame member and supporting a center portion of said screw for rotation, and a pair of thrust collars mounted on said screw on opposite sides of said support block for axial adjustment to provide for precisely positioning said arms and said bending rollers relative to said die.

15. Apparatus as defined in claim 14 wherein each of said arms has a substantially flat cam surface, a corresponding bearing member having a substantially flat surface slidably engaging said cam surface, and said adjustment screw is threadably connected with reverse threads to both of said bearing members for precisely adjusting the spacing between said bending rollers.

16. Apparatus as defined in claim 14 wherein said frame comprises a steel tube having parallel spaced front and rear walls, said means supporting said carriage member for linear movement comprise a plate secured to said front wall, and block members mounted on portions of said plate and supporting parallel spaced guide rods for said carriage.

17. Apparatus as defined in claim 14 wherein said frame member comprises a steel tube having parallel spaced front and rear walls, and said means supporting said carriage member comprise a plate secured to said front wall.

18. Apparatus as defined in claim 14 and including a support block supported by said frame member and supporting a center portion of said screw for rotation, and a pair of thrust collars mounted on said screw on opposite sides of said support block for axial adjustment to provide for precisely positioning said arms and said bending rollers relative to said die.

19. Apparatus as defined in claim 14 wherein each of said arms has a length between the pivot axis for said arm and the axis of the corresponding said bending roller of substantially more than 18 inches.

20. Apparatus for bending a straight metal rod having a center portion integrally connecting opposite threaded end portions into a U-bolt having parallel legs formed from the end portions, said apparatus comprising a vertical tubular frame including a lower portion and an upper portion, a forming die supported by said lower portion of said frame and adapted to receive the center portion of the rod, a pair of generally vertical support arms each supporting a bending roller positioned to engage the rod, a carriage member pivotally supporting said arms, generally vertical guide means mounted on said frame and supporting said carrier member for generally vertical movement between an upper retracted position and a lower extended position, power operated means for moving said carriage member and said arms between said retracted and extended positions, each of said arms having a generally flat cam surface, a bearing member having a generally flat face engaging each of said cam surfaces and providing for moving said arms and said rollers inwardly towards each other along converging paths when said carriage member moves to said extended position for overbending the rod around said die, and an adjustment screw connecting said bearing members for simultaneously adjusting said arms in response to rotation of said screw for conveniently adjusting the spacing between said bending rollers to accommodate rods and dies of different sizes.

21. Apparatus as defined in claim 20 wherein each of said arms comprises a set of parallel spaced plates each having laterally aligned slots forming said cam surfaces, one of said bearing members extending between said plates of each said arm, and said adjusting screw extends between said plates of each said arm and has threaded portions engaging said bearing members.

22. Apparatus as defined in claim 20 and including means for positively clamping and locking the center portion of the rod to said die member during operation of said operated means and bending of the rod, and said clamping and locking means comprise a power actuated sliding wedge member.

* * * * *